US007584907B2

(12) United States Patent
Contadini et al.

(10) Patent No.: US 7,584,907 B2
(45) Date of Patent: Sep. 8, 2009

(54) PRECISION RELEASE AEROSOL DEVICE

(76) Inventors: Carl D. Contadini, 300 Bartholomew Hill Rd., Goshen, CT (US) 06756; Perry Skeath, 1113 Dennis Ave., Woodmoor, MD (US) 20901

( * ) Notice: Subject to any disclaimer, the term of this patent is extended or adjusted under 35 U.S.C. 154(b) by 310 days.

(21) Appl. No.: 11/092,108

(22) Filed: Mar. 29, 2005

(65) Prior Publication Data

US 2006/0229232 A1 Oct. 12, 2006

(51) Int. Cl.
*B05B 1/14* (2006.01)

(52) U.S. Cl. ..... 239/590; 239/69

(58) Field of Classification Search ..... 239/590, 239/589, 596, 533.12, 533.14, 102.1, 67, 239/69

See application file for complete search history.

(56) References Cited

U.S. PATENT DOCUMENTS

| | | | | |
|---|---|---|---|---|
| 2,599,422 | A * | 6/1952 | Yettaw | 239/427 |
| 2,826,453 | A | 3/1958 | Kiraly et al. | |
| 3,120,348 | A * | 2/1964 | O'Donnell | 239/490 |
| 3,589,563 | A | 6/1971 | Carragan | |
| 3,756,472 | A | 9/1973 | Vos | |
| 4,077,542 | A | 3/1978 | Petterson | |
| 5,449,114 | A * | 9/1995 | Wells et al. | 239/5 |
| 5,772,074 | A | 6/1998 | Dial et al. | |
| 5,797,898 | A | 8/1998 | Santini, Jr. et al. | |
| 5,957,125 | A | 9/1999 | Sagstetter et al. | |
| 6,058,932 | A | 5/2000 | Hughes | |
| 6,123,861 | A | 9/2000 | Santini, Jr. et al. | |
| 6,189,214 | B1 | 2/2001 | Skeath et al. | |
| 6,189,813 | B1 | 2/2001 | Skeath et al. | |
| 6,267,297 | B1 * | 7/2001 | Contadini et al. | 239/1 |
| 6,352,209 | B1 | 3/2002 | Skeath et al. | |
| 6,378,788 | B1 | 4/2002 | Skeath et al. | |
| 6,513,736 | B1 | 2/2003 | Skeath et al. | |
| 6,517,009 | B2 | 2/2003 | Yahav | |
| 6,537,256 | B2 | 3/2003 | Santini, Jr. et al. | |
| 6,540,155 | B1 | 4/2003 | Yahav | |
| 6,551,838 | B2 | 4/2003 | Santini, Jr. et al. | |

* cited by examiner

*Primary Examiner*—Davis Hwu
(74) *Attorney, Agent, or Firm*—Carmody & Torrance LLP

(57) ABSTRACT

The invention is directed to a precision release aerosol dispenser for dispensing material from a pressurized source of material. The precision release aerosol dispenser comprises dispensing means for dispensing into the environment the material from the source of material, a microchip coupled to the dispensing means for controlling the release rate of the material to be dispensed, and means for initiating the dispensing means. The microchip usable in the precision aerosol dispenser of the invention is a multilayer device fabricated using MEMS fabrication techniques.

15 Claims, 4 Drawing Sheets

PRECISION RELEASE AEROSOL DEVICE

FIELD OF THE INVENTION

The invention is directed to an improved means for controlling the discharge of fluid from a pressurized container.

BACKGROUND OF THE INVENTION

Certain products, such as insecticides and air sanitizers are commonly supplied in pressurized containers. The contents of the pressurized container are typically dispensed to the atmosphere by pressing down on a valve at the top of the container so that the contents of the container are emitted through a channel in the valve.

In some instances it is desirable that the contents of the container be automatically dispensed periodically. In other instances however, it is desirable to continuously expel the contents of the container at a slow rate over a long period of time. For example, the dispensing of a product for an extended period of time may negate the necessity of concentrated (i.e., puffs) of material resulting from the periodic dispensing of material. An additional advantage realized by a controlled continuous flow of the pressurized product is that the pressurized container may be left unattended for long periods of time while maintaining a continuous discharge of the product.

U.S. Pat. No. 6,540,155 to Yahav describes periodic dispensing of a spray and the amount of spray emitted at each period being controlled by setting the time in which the outlet is open, such as by operating the dispenser in response to a sensor which measures the level of material in the surroundings. The dispenser of Yahav is limited in that it requires a sensor to determine that the minimal level of material is not sufficient.

U.S. Pat. No. 3,756,472 to Vos, describes a micro-emitter for pressure packages comprising an apertured member disposed across the nozzle opening through which a fluid product in a pressurized container may be expelled. The apertured member serves to control the flow of the fluid and assist in droplet formation. However, Vos does not describe any preferred means of fabricating the micro-emitter and does not describe a micro-emitter that may be used replaceably with other types of spray dispensers.

Thus there remains a need for continued improvement of systems that allow for a slow release of a pressurized product in a cost effective manner, which can be provided, for example, in a continuous manner and without a power source (e.g. batteries).

The inventors of the present invention have determined that the use of micro-electromechanical (MEMS) fabrication techniques may be advantageously used to construct a microchip that allows for the continuous dispensing of material from a pressurized container, while overcoming many of the deficiencies of the prior art.

Micro-electromechanical systems (MEMS) is a process technology used to create tiny integrated devices or systems that combine mechanical and electrical components. MEMS are fabricated using integrated circuit (IC) batch fabrication techniques and can range in size from a few micrometers to a few millimeters. MEMS takes advantage of silicon's mechanical properties, or its electrical and mechanical properties, and MEMS components are generally fabricated by sophisticated manipulations of silicon (and other substrates) using micromachining processes.

MEMS, with its batch fabrication techniques, enables components and devices to be manufactured with increased performance and reliability, and provide the advantages of reduced physical size, volume, weight, and cost. To date, MEMS have found commercial success in applications such as automotive airbag sensors, medical pressure sensors, inkjet print heads, and overhead projection displays and are being developed for use as bioMEMS, in optical communications (MOEMS) and as radio frequency (RF) MEMS.

MEMS fabrication uses high volume IC-style batch processing that involves the addition or subtraction of two-dimensional layers on a substrate based on photolithography and chemical etching. As a result, the 3D aspect of MEMS devices is due to patterning and interaction of the 2D layers. Additional layers can be added using a variety of thin film and bonding techniques as well as by etching through sacrificial "spacer layers."

Photolithography is a photographic technique that is used to transfer copies of a master pattern, typically a circuit layout in IC applications, onto the surface of a substrate of some material. The substrate is covered with a thin film of some material, usually silicon dioxide, in the case of silicon wafers, on which a pattern of holes will be formed. A thin layer of an organic polymer, which is sensitive to ultraviolet radiation, is then deposited on the oxide layer; this is called a photoresist. A photomask, consisting of a transparent glass plated with an opaque pattern, is then placed in contact with the photoresist coated surface. The wafer is exposed to the ultraviolet radiation, transferring the pattern on the mask to the photoresist which is then developed in a way similar to the process used for developing photographic films. The radiation causes a chemical reaction in the exposed areas of the photoresist, of which there are two types—positive and negative. Positive photoresist is strengthened by UV radiation while negative photoresists are weakened. On developing, the rinsing solution removes either the exposed areas or the unexposed areas of photoresist, leaving a pattern of bare and photoresist-coated oxides on the wafer surface. The resulting photoresist pattern is either the positive or negative image of the original pattern of the photomask.

A chemical (i.e., hydrochloric acid) is used to attack and remove the uncovered oxide from the exposed areas of the photoresist. The remaining photoresist is subsequently removed with a chemical that attacks the photoresist but not the oxide layer on the silicon (i.e., hot sulfuric acid), leaving a pattern of oxide on the silicon surface. The final oxide pattern is either a positive or negative copy of the photomask pattern and serves as a mask in subsequent processing steps. The oxide then serves as a subsequent mask for either further additional chemical etching, creating deeper 3D pits or new layers on which to build further layers, resulting in an overall 3D structure or device.

The most common substrate material for micromachining is silicon for a variety of reasons, including: 1) silicon is abundant, inexpensive, and can be processed to a high degree of purity; 2) silicon can be easily deposited in thin films; and 3) silicon microelectronics circuits are batch fabricated (a silicon wafer contains hundreds of identical chips, not just one).

Although silicon is most commonly used, other substrate materials, including crystalline semiconductors such as germanium and gallium arsenide, and non-semiconductor substrate materials such as metals, glass, quartz, crystalline insulators, ceramics, and polymers, have also been suggested for use in MEMS fabrication.

In order to form more complex and larger MEMS structures, micromachined silicon wafers can be bonded to other materials in a process known as fusion bonding, which is a technique that enables virtually seamless integration of multiple layers and relies on the creation of atomic bonds between each layer. In the case of glass to wafer bonding, a direct bond is created by heat and pressure.

MEMS has many applications in microfluidics with many of the key building blocks such as flow channels, pumps, and valves being amenable to being fabricated using micromachining techniques. The inventors of the present invention have determined that MEMS fabrication techniques may be used to produce microchips that are usable to provide the slow release of contents from an aerosol container in a cost-effective and predictable manner. To that end, the inventors of the instant invention have used MEMS fabrication techniques to develop a microchip that is usable with a dispensing means to control the flow of fluid from a pressurized container of the fluid.

SUMMARY OF THE INVENTION

It is an object of the present invention to provide a precision release aerosol dispenser that allows for the slow, controlled release of a source of material to be dispensed.

It is another object of the present invention to provide a precision release aerosol dispenser that does not require an external power source.

It is still another object of the present invention to use MEMS fabrication techniques to construct a microchip that is usable in a dispenser of the invention.

To that end, the present invention is directed to an improved dispenser that allows for the controlled release of a pressurized (i.e., aerosolized) source of material into the environment, comprising dispensing means for dispensing into the environment the material from the source of material; a microchip coupled to the dispensing means for controlling the release rate of the material to be dispensed; and means for initiating the dispensing means.

In a specific embodiment, the microchip of the invention comprises a first glass wafer having a channel therein to allow passage of the material to be dispensed; a filter wafer disposed on the first glass layer, said filter wafer comprising a plurality of pores extending therethrough, said pores being sized to prevent particles above a selected size from passing through the filter wafer; a second glass wafer disposed on the filter wafer, said second glass wafer having a channel in passage alignment with the plurality of pores of the filter wafer; and an orifice wafer disposed on the second glass wafer, said orifice wafer having a bottom surface and a top surface and a channel therethrough, said channel having an entrance at the bottom surface of the orifice wafer and an exit at the top surface of the orifice wafer, said channel being in passage alignment with the channel of the second glass wafer; whereby the material to be dispensed is provided a passageway through the channel in the first glass wafer, through the plurality of pores of the filter wafer, through the channel in the second glass water and out the exit at the top surface of the orifice wafer.

In a specific embodiment, the dispensing means of the invention comprises a spray valve assembly and the means for initiating the dispensing means comprises a locking assembly that is operatively coupled to the spray valve assembly. Placing the locking cap in a locked position maintains the spray valve assembly in an open condition causing the release of the source of material through the exit of the orifice wafer.

In the specific embodiment, the material is released as long as the spray valve assembly is in an open condition. Furthermore, so long as the locking assembly is in a locked condition, no external power source is needed to maintain the releasing of the material from the source of material.

BRIEF DESCRIPTION OF THE DRAWINGS

Identical reference numerals in the figures are intended to indicate like features, although not every feature in every figure may be called out with a reference numeral.

DETAILED DESCRIPTION OF THE PREFERRED EMBODIMENTS OF THE INVENTION

Figure 1:
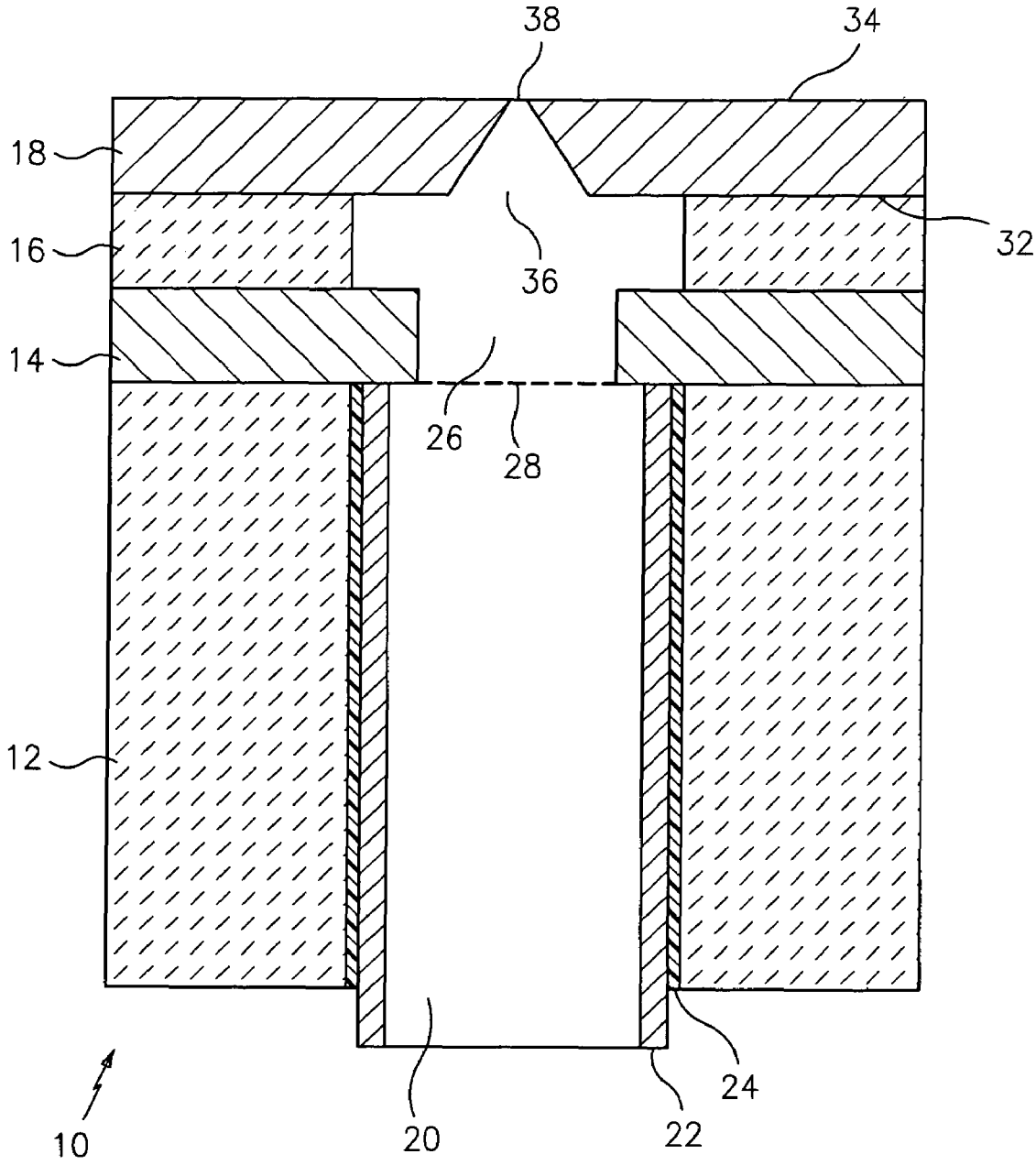
FIG. 1 depicts a microchip that is usable in the precision release aerosol dispenser of the invention.

The present invention is directed to the use of a microchip coupled to a dispensing means for controlling the flow of fluid from a pressurized container of the fluid.

The improved dispenser of the inventions allows for the slow release of a pressurized (i.e., aerosolized) source of material into the environment without the need for an external power source.

In one embodiment, the present invention is directed to an improved dispenser that allows for the controlled release of a pressurized (i.e., aerosolized) source of material into the environment, comprising dispensing means for dispensing into the environment the material from the source of material; a microchip coupled to the dispensing means for controlling the release rate of the material to be dispensed; and means for initiating the dispensing means.

In a specific embodiment, the microchip of the invention comprises a first glass wafer having a channel therein to allow passage of the material to be dispensed; a filter wafer disposed on the first glass layer, said filter wafer comprising a plurality of pores extending therethrough, said pores being sized to prevent particles above a selected size from passing through the filter wafer; a second glass wafer disposed on the filter wafer, said second glass wafer having a channel in passage alignment with the plurality of pores of the filter wafer; and an orifice wafer disposed on the second glass wafer, said orifice wafer having a bottom surface and a top surface and a channel therethrough, said channel having an entrance at the bottom surface of the orifice wafer and an exit at the top surface of the orifice wafer, said channel being in passage alignment with the channel of the second glass wafer; whereby the material to be dispensed is provided a passageway through the channel in the first glass wafer, through the plurality of pores of the filter wafer, through the channel in the second glass water and out the exit at the top surface of the orifice wafer.

In a specific embodiment, the dispensing means of the invention comprises a spray valve assembly and the means for initiating the dispensing means comprises a locking assembly that is operatively coupled to the spray valve assembly. Placing the locking cap in a locked position maintains the spray valve assembly in an open condition causing the release of the source of material through the exit of the orifice wafer.

In the specific embodiment, the material is released as long as the spray valve assembly is in an open condition. Furthermore, so long as the locking assembly is in a locked condition, no external power source is needed to maintain the releasing of the material from the source of material.

The material to be dispensed typically comprises an olfactory stimulating material or a pesticide. By "olfactory stimulating material" is meant any material that affects the olfactory response to the environment of a room or like space. Included within the term "olfactory stimulating material" are fragrances, perfumes, deodorizing components, etc. Such materials are generally liquid in active form, i.e., when vaporized in the environment to provide olfactory stimulating effects. However, the present invention is not limited to the dispensing of pesticides and olfactory stimulating materials, but may be used for any material for which dispensing, as set forth below, is desired.

Figure 2:
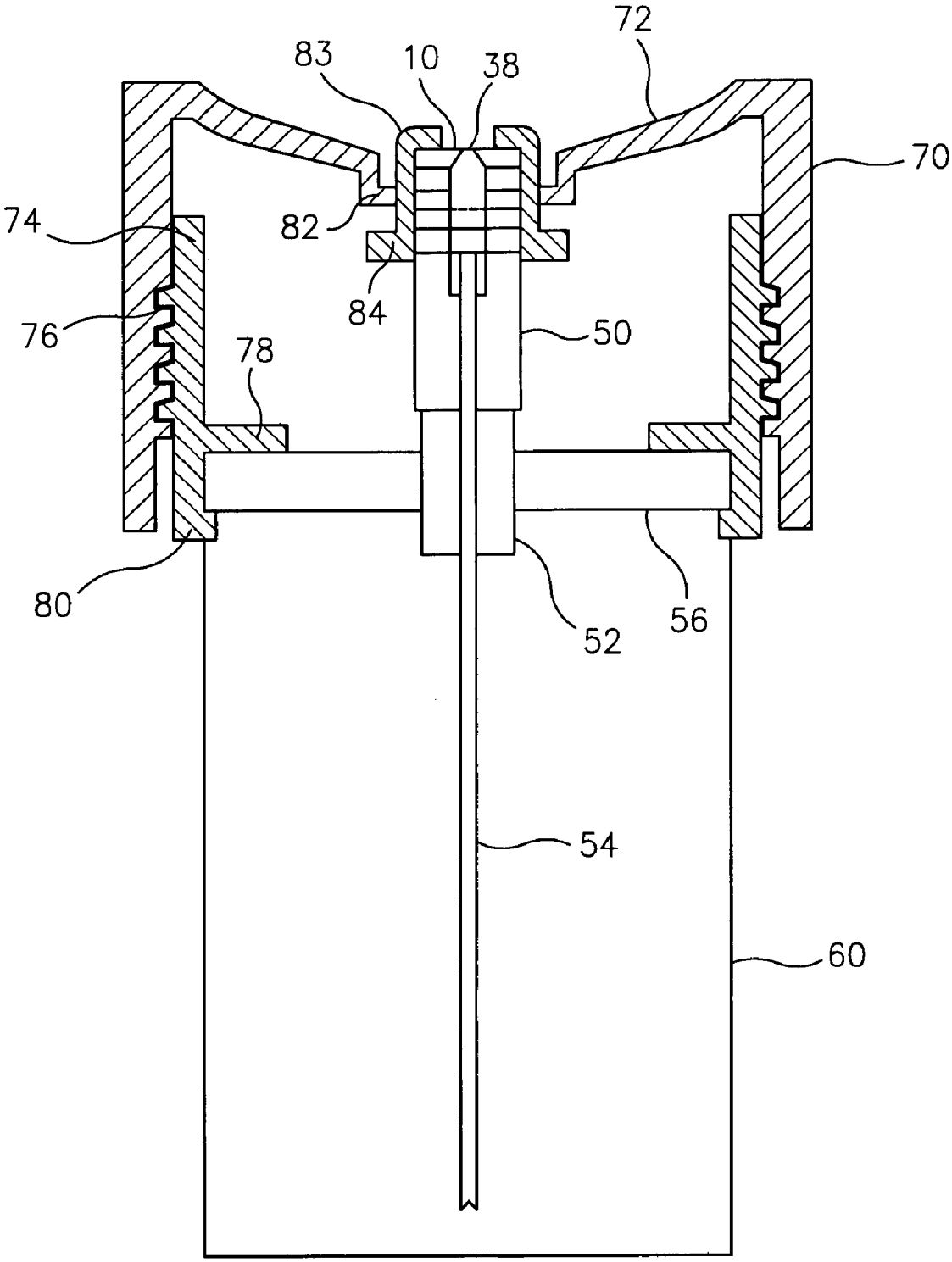
FIG. 2 depicts a precision release aerosol dispenser of the invention with a locking cap that allows for continuous release of a source of material.

The dispensing means is preferably a conventional spray valve having a valve stem (50) and a spray valve mechanism (52), as shown in FIG. 2. The particular spray valve configuration is not critical and any suitable spray valve that is capable of dispensing a pressurized flow of fluid at a controlled rate may be usable in the invention.

The microchip (10) controls the rate that the source of material is released into the environment. The microchip (10) is fabricated using standard micro-electromechanical (MEMS) fabrication techniques as would be well understood by one ordinarily skilled in the art. The microchip (10) is preferably coupled to the valve stem (50) of the aerosol valve (52).

The microchip (10) of the invention preferably comprises a variety of layers that are fused together. In a preferred embodiment, the layers of the microchip (10) of the invention are fused together using heat and pressure.

As seen in FIG. 1, the microchip (10) of the invention comprises, in order:

a) a first glass wafer (12);

b) a filter wafer (14);

c) a second glass wafer (16); and d) an orifice wafer (18).

As seen in FIG. 1, the first glass wafer (12) has a channel therein (20) to allow passage of the material dispensed from the source of material (60) through the aerosol valve (52). Most preferably the first glass wafer (12) is a Pyrex® wafer that is approximately ⅛-inch (3.175 mm) thick and has a width of about 4.200 millimeters. The channel (20) extends from the bottom surface of the wafer to the top surface of the wafer and in one embodiment, has a diameter of about 1.750 millimeters, although other diameters would also be usable in the practice of the invention.

In a preferred embodiment, the channel (20) through the first glass wafer (12) is lined with a stainless steel tube (22) that may be used to join the microchip (10) to the valve stem (50) of the aerosol valve (52). The stainless steel tube (22) typically has an outer diameter of 0.065 inches and a wall thickness of about 0.006 inches (1.50 μm) and is preferably joined to the first glass wafer (12) by means of an epoxy layer (24) having an approximate thickness of 0.003 inches (0.75 μm), although other materials that would create a tight bond between the glass wafer (12) and the stainless steel tube (22) are also usable in the practice of the invention. The stainless steel tube also typically extends beyond the bottom surface of the first glass wafer to couple the microchip (10) to the valve stem (50) (shown in FIG. 2). The microchip (10) is typically coupled to the valve stem (50) using an adhesive, although other means of sealing the components together would also be known to those skilled in the art.

Disposed on top of the first glass wafer (12) is a filter wafer (14) that comprises silicon and is approximately 0.500 millimeters thick. The filter wafer (14) has a filter slot (26) that extends from a bottom surface of the filter wafer (14) to a top surface of the filter wafer (14). The filter slot (26) is typically round and is approximately 1.050 mm in diameter. The filter slot (26) is oriented so that it lines up with the opening (20) of the first glass wafer (12).

The filter slot (26) comprises a plurality of pores (28) that extend through the filter wafer (14) from the bottom surface to the top surface, although for improved clarity, the plurality of pores (28) depicted in FIG. 1 are not shown as extending through the filter wafer. The plurality of pores (28) are sized to prevent particles above a selected size from passing through the filter wafer (14), which particles (e.g. contaminants) that would clog the exit opening (38) of the orifice wafer (18). The plurality of pores (28) are preferably round or square in shape, although the shape of the plurality of pores (28) is not critical and is based on the MEMS fabrication techniques used. If the pores (28) are square, each side of the square typically measures about 2 to about 3 microns. If the pores (28) are substantially round, the diameter of each of the pores is about 2 to 3 microns. The pores (28) of the filter wafer (14) are also designed to be smaller than the exit opening (38) of the orifice wafer (18).

A second glass (i.e., Pyrex®) wafer (16) is then disposed on top of the filter wafer (14), and is approximately 0.500 millimeters thick. The second glass wafer (16) has a channel that is approximately the same size as that of the first glass wafer (12) and is oriented to line up with the openings of the first glass wafer (12) and the filter wafer (14). While the width of the channel of the first glass wafer (12) and the second glass wafer (16) is not critical, it is preferred that the channels of the first glass wafer (12) and the second glass wafer (16) be least as large as the filter slot opening (26) of the filter wafer (14).

Finally, orifice wafer (18) is disposed on top of the second glass wafer (16). The orifice wafer has a bottom surface (32) and a top surface (34) and a channel therethrough. The bottom surface (32) comprises an entrance opening (36) that is oriented to line up with the openings of the first and second glass wafers (12) and (16) as well as the filter wafer (14). The entrance opening (36) tapers to a smaller exit opening (38) in the top surface (34) of the orifice wafer (18). The tapering of the entrance opening (36) of the orifice wafer (18) directs the material to be dispensed towards the exit opening (38).

Similarly to the plurality of pores (28) of the filter wafer (14), the exit opening (38) of the orifice wafer (18) is preferably substantially square or substantially round, depending on the MEMS fabrication techniques used. If the exit opening (38) of the orifice wafer (18) is substantially square, its dimensions are from about 3 microns square to about 20 microns square, more preferably from about 3 microns square to about 10 microns square. If the exit opening (38) of the orifice wafer (18) is substantially round, its diameter is generally about 3 microns to about 20 microns, more preferably about 3 microns to about 10 microns. The size of the exit opening (38) controls the release rate of the source of material that is dispensed and may be chosen to yield the desired release rate of material, depending on the particular application.

The first glass wafer (12), the filter wafer (14), the second glass wafer (16), and the orifice wafer (18) of the microchip (10) are joined together by fusing the layers together with heat and pressure. Although other materials may be used, it is generally preferred that both the filter wafer (14) and the orifice wafer (18) be made of silicon and that the first glass wafer (12) and the second glass wafer (16) be Pyrex®.

The microchip (10) usable in the instant invention is preferably constructed using MEMS fabrication techniques. One of the key benefits of the use of MEMS fabrication techniques is that multiple microchips (10) may be simultaneously processed, thus improving the reproducibility of the device. The use of MEMS fabrication also allows for more precise registration of the layers, one on top of the other, so that the openings of each layer line up properly.

The invention also preferably comprises means for allowing the dispensing means to be operated. While the specific means is not critical, it is preferred that the means for allowing the source of material to be dispensed (e.g. continuously) be easy to use and allow for the dispensing means to be initiated so that the operator may use the system of the invention continuously for the length of time he desires. By "continuously" Applicants mean for a predetermined length of time, which can be a number of seconds, minutes, hours, or days. The length of time is not critical, but use of the term "continuously" as meant herein is not intended to allow a "design around" by a construction in which the release is temporarily inhibited. That is, the use of the term "continuously" is intended merely to distinguish the present invention from the prior art which, for example, dispenses once every fifteen minutes.

The means for allowing the dispensing means to be operated is constructed so that it may be readily affixed to a valve cap (56) that is mounted to the top of the container (60) housing the source of material to be dispensed. The valve cap (56) serves to position the spray valve assembly (52) and dip tube (54) in the container (60) housing the source of material.

In one embodiment, the means for allowing the dispensing means to be operated is a locking assembly. The locking assembly includes a cylinder-shaped upstanding member (74) having exterior threads (76), an interior annular flange (78) positioned upwardly of the bottom of the cylinder and securing means such as an annular bead (80) disposed inwardly at the bottom edge of the cylinder. The annular flange (78) engages the top of the valve cap (56) and the securing means (80) engages the lower lip of the valve cap (56) so that the cylinder (74) may be snapped onto the locking cap (70) and held securely thereto. Rotatably threaded onto the upstanding cylinder (74) is the locking cap (70) having a concave top (72). A central orifice in the concave top (72) permits the top hat (83) to extend therethrough; and the edge of the orifice defines a shoulder engageable with the annular flange (84) of the top hat (83). The top hat (83) rests on the microchip (10) of the invention.

The locking assembly is operated by rotating the locking cap (70), for example, in a clockwise direction to screw the same in a downwardly direction. The shoulder (82) then engages the annular flange (84) and depresses the top hat (83) and valve stem (50) to open the valve (52), whereby the source of material is released through the exit orifice (38) of the microchip (1) of the invention. The valve (52) may then be left open for as long as needed and may thereafter be closed by simply unscrewing the locking cap (70) to release the pressure on the valve stem (50) to close the valve (52). It is noted that the continuous dispensing of the pressurized product is maintained as long as the locking cap (70) is screwed downwardly as shown in FIG. 2.

It is noted that the locking assembly described above is only an example of one suitable means for initiating dispensing, and the invention is not limited to the above described locking cap. Other means that would allow the contents of the source of material to be dispensed (e.g. continuously) through the dispensing means and microchip of the invention would be known to those skilled in the art and are usable in the practice of the instant invention.

In one embodiment of the invention, the precision release aerosol dispenser may be contained in a housing such that the dispenser may be removeably replaced. Such systems are well-known in the art as described for example in U.S. Pat. No. 5,772,074 to Dial et al., the subject matter of which is herein incorporated by reference in its entirety. If used, the housing comprises a vent through which the source of material may be dispensed into the environment surrounding the housing. The housing can be made of any suitable material, such as a plastic, like low- or high-density polyethylene, polypropylene or medium impact styrene, and can be made by any suitable method, such as by injection molding.

The housing generally includes an internal cavity into which a source of material to be dispensed may be inserted. The housing can stand freely on a surface or it can be mounted on a surface, such as a wall, or other vertical surface through back. Preferably, the front of the housing is hingeably secured to housing, to permit opening of housing, and insertion of a source of material to be dispensed into the cavity.

The material to be dispensed may be a pesticide, such as an insecticide. In this instance, the dispenser of the invention may be positioned in mosquito habitats, gardens, greenhouses or another other location where it is desired to spray against insects.

In the alternative, the material to be dispensed may be an olfactory stimulating material. In this instance, the dispenser of the invention may be positioned in a public restroom or another location where its use is desired.

The source of material to be dispensed is preferably pressurized at a rate of about 65 to about 85 psi, although other pressures would also be usable in the practice of the invention.

EXAMPLE

Figure 3:
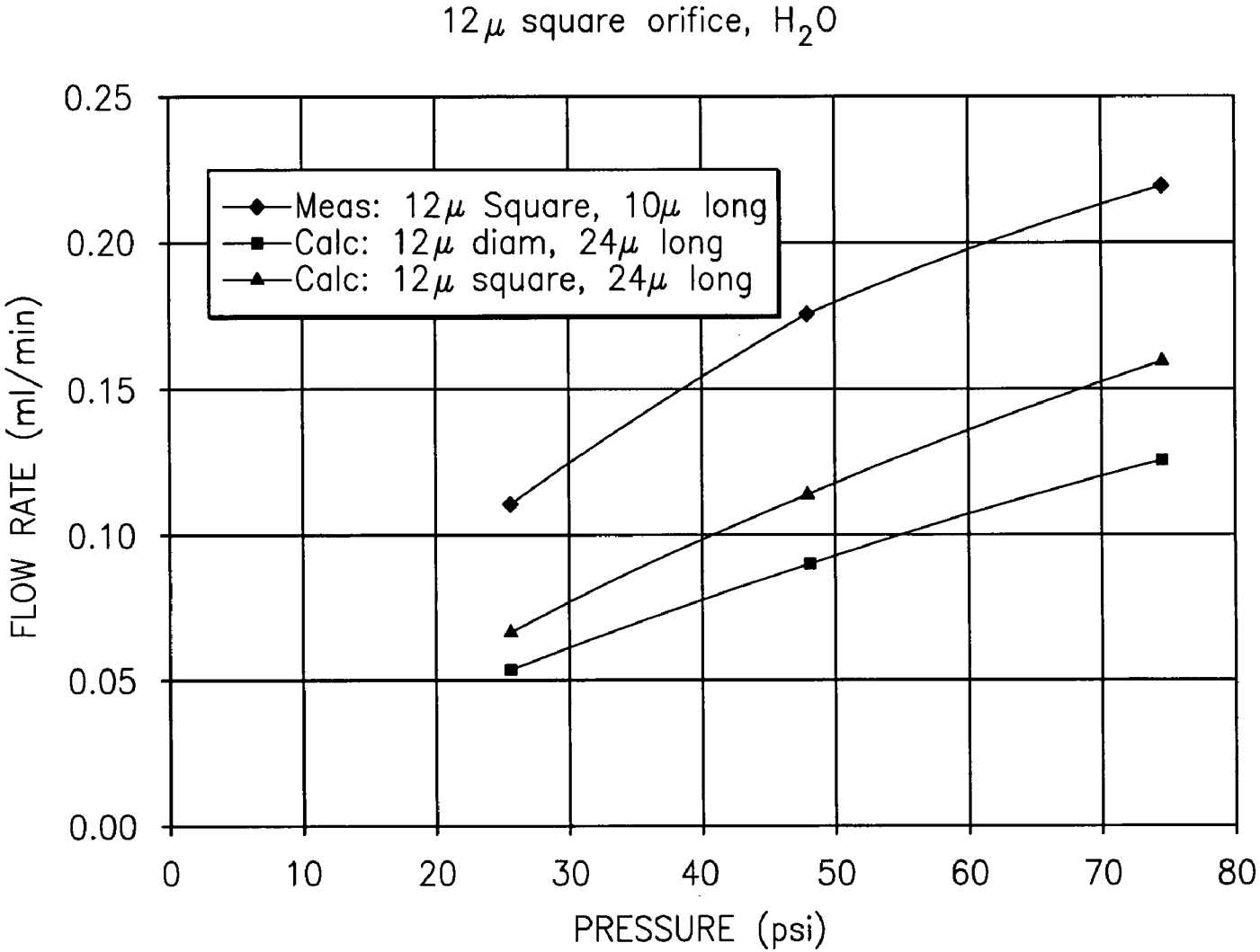
FIG. 3 presents a graph of the flow rate versus pressure using a microchip with a 12 μm square exit orifice.
Figure 4:
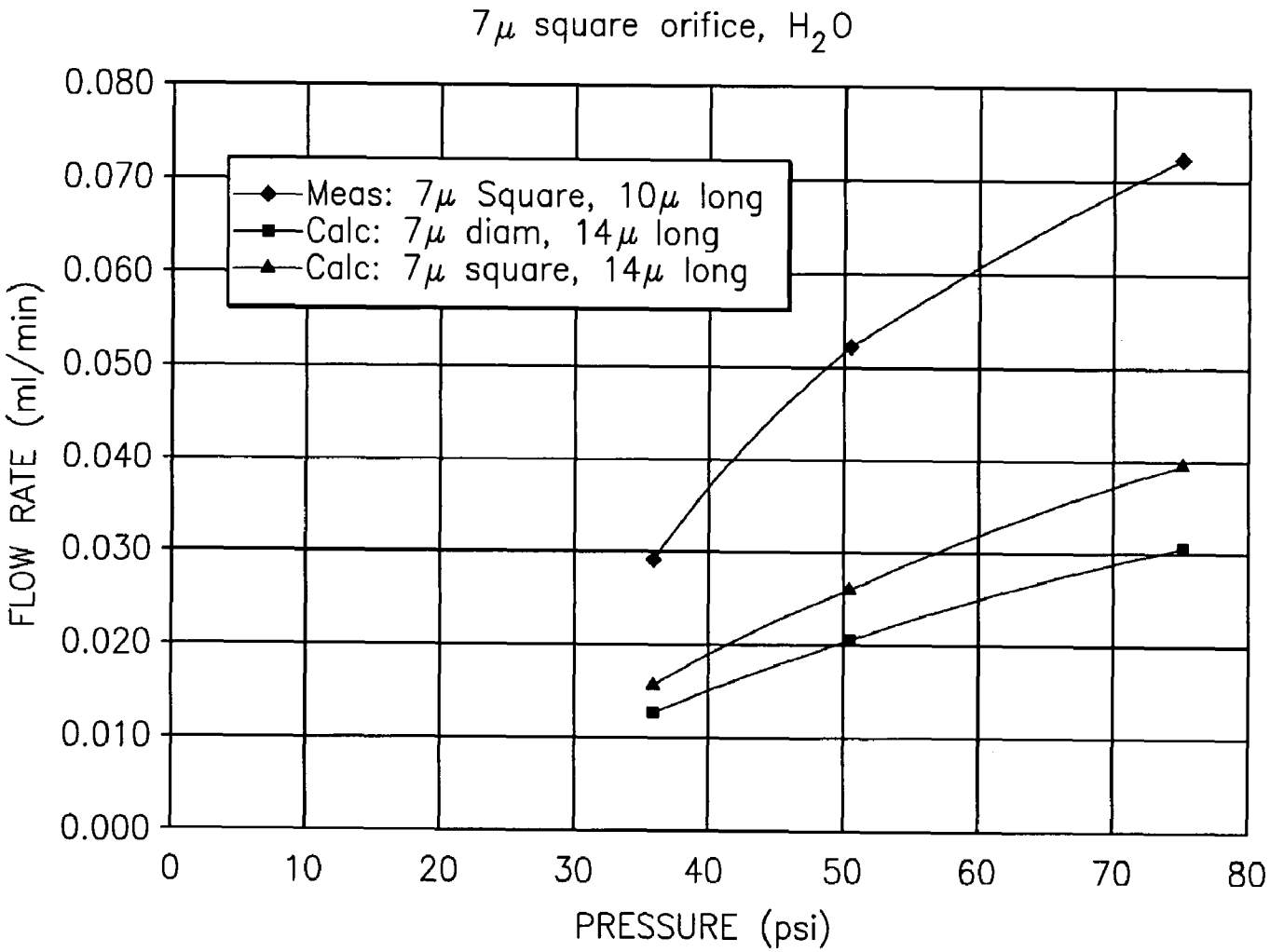
FIG. 4 presents a graph of the flow rate versus pressure using a microchip with a 7 μm square exit orifice.

Microchips of the invention were tested using water to simulate aerosol flow through the microchip of the invention. Openings of 7 μm and 12 μM were investigated. No clogging or slowdown of flow was observed over a one-hour period. The data are presented in Table 1 for a 12 μm orifice and in Table 2 for a 7 μm orifice. A graph of flow rate versus pressure is presented in FIG. 3 for a microchip having 12 μm exit orifice and in FIG. 4 for a microchip having a 7 μm exit orifice.

TABLE 1

Test results for a 12 μm square orifice

| | Units | Sample 1 | Sample 2 | Sample 3 |
|---|---|---|---|---|
| Pressure 1 | Psi | 74.9 | 48.2 | 25.6 |
| Volume 1 | Ml | 0 | 0 | 0 |
| Pressure 2 | Psi | 74.3 | 78.2 | 25.5 |
| Volume 2 | Ml | 4.4 | 2.65 | 3.35 |
| Average ΔP | Psi | 74.6 | 48.2 | 25.55 |
| ΔVolume | Ml | 4.4 | 2.65 | 3.35 |
| Δtime | Minutes | 20 | 15 | 30 |
| Q measured | ml/minute | 0.22 | 0.18 | 0.11 |
| Orifice edge | Cm | 0.0012 | 0.0012 | 0.0012 |
| Orifice area | $cm^2$ | 1.4E−06 | 1.4E−06 | 1.4E−06 |
| Average velocity | m/s | 25.46 | 20.45 | 12.92 |
| Q calculated (round) | ml/minute | 0.126 | 0.091 | 0.053 |
| Q calculated (square) | ml/minute | 0.16 | 0.12 | 0.07 |

TABLE 2

Test results for a 7 μm square orifice

| | Units | Sample 1 | Sample 2 | Sample 3 |
|---|---|---|---|---|
| Pressure 1 | Psi | 75.3 | 50.4 | 35.3 |
| Volume 1 | Ml | 0 | 0 | 0 |
| Pressure 2 | Psi | 75 | 50.4 | 35.2 |
| Volume 2 | Ml | 1.8 | 2.4 | 1.0 |
| Average ΔP | Psi | 75.15 | 50.4 | 35.25 |
| ΔVolume | Ml | 1.8 | 2.4 | 1.4 |
| Δtime | Minutes | 25 | 46 | 48.5 |

TABLE 2-continued

Test results for a 7 μm square orifice

| | Units | Sample 1 | Sample 2 | Sample 3 |
|---|---|---|---|---|
| Q measured | ml/minute | 0.072 | 0.052 | 0.029 |
| Orifice edge | Cm | 0.0007 | 0.0007 | 0.0007 |
| Orifice area | $cm^2$ | 4.9E−07 | 4.9E−07 | 4.9E−07 |
| Average velocity | m/s | 24.49 | 17.75 | 9.82 |
| Q calculated (round) | ml/minute | 0.031 | 0.02 | 0.012 |
| Q calculated (square) | ml/minute | 0.04 | 0.03 | 0.02 |

While the invention has been particularly shown and described with respect to preferred embodiments thereof, it will be understood by those skilled in the art that changes in form and details may be made therein without departing from the scope and spirit of the invention.

It can thus be seen that the present invention provides for significant advancements over the prior art for providing a controlled release of a dispensing material. In particular, the present invention allows for the material to be released so long as the spray valve is in an open position. Furthermore, the improved aerosol dispenser of the invention requires no external power source for operation.

It is also to be understood that the following claims are intended to cover all of the generic and specific features of the invention described herein and all statements of the scope of the invention which as a matter of language might fall therebetween.

What is claimed is:

1. A precision release aerosol dispenser for providing a controlled release of a dispensing material from a pressurized source of material, the precision release aerosol dispenser comprising:

dispensing means for dispensing into the environment the material from the source of material;

a microchip coupled to the dispensing means for controlling the release rate of the material to be dispensed; and means for initiating the dispensing means;

wherein the microchip comprises:

a first glass wafer having a channel therein to allow passage of the material to be dispensed;

a filter wafer disposed on the first glass layer, said filter wafer comprising a plurality of pores extending therethrough, said pores being sized to prevent particles above a selected size from passing through the filter wafer;

a second glass wafer disposed on the filter wafer, said second glass wafer having a channel in passage alignment with the plurality of pores of the filter wafer; and an orifice wafer disposed on the second glass wafer, said orifice wafer having a bottom surface and a top surface and a channel therethrough, said channel having an entrance at the bottom surface of the orifice wafer and an exit at the top surface of the orifice wafer, said channel being in passage alignment with the channel of the second glass wafer;

whereby the material to be dispensed is provided a passageway through the channel in the first glass wafer, through the plurality of pores of the filter wafer, through the channel in the second glass water and out the exit at the top surface of the orifice wafer.

2. The precision release aerosol dispenser of claim 1, wherein the first glass wafer, the filter wafer, the second glass wafer, and the orifice wafer are joined together by fusing the layers together.

3. The precision release aerosol dispenser according to claim 1, wherein the microchip is constructed using microelectromechanical fabrication.

4. The precision release aerosol dispenser according to claim 3, wherein each of the plurality of pores in the filter wafer is square.

5. The precision release aerosol dispenser according to claim 4, wherein each of the plurality of pores in the filter wafer is about 2 microns square to about 3 microns square.

6. The precision release aerosol dispenser according to claim 3, wherein each of the plurality of pores in the filter wafer is circular.

7. The precision release aerosol dispenser according to claim 6, wherein each of the plurality of pores in the filter wafer is about 2 to 3 microns in diameter.

8. The precision release aerosol dispenser according to claim 1, wherein each of the pores of the filter wafer is smaller than the exit opening of the orifice wafer.

9. The precision release aerosol dispenser according to claim 1, wherein the exit opening of the orifice wafer is substantially square or substantially round.

10. The precision release aerosol dispenser according to claim 9, wherein if the exit opening of the orifice wafer is substantially square it is about 3 to 20 square microns, and if the exit opening of the orifice wafer is substantially round, it is about 3 to about 20 microns in diameter.

11. The precision release aerosol dispenser according to claim 1, wherein the channel in the first glass wafer is lined with a stainless steel tube and is joined to the glass wafer by means of an epoxy layer.

12. The precision release aerosol dispenser according to claim 11, wherein the stainless steel tube couples the microchip to the dispensing means.

13. The precision release aerosol dispenser according to claim 1, wherein the filter wafer and the orifice wafer are comprised of silicon.

14. A precision release aerosol dispenser for providing a controlled release of a dispensing material from a pressurized source of material, the precision release aerosol dispenser comprising:

a dispensing assembly for dispensing into the environment the material from the source of material;

a microchip coupled to the dispensing assembly for controlling the release rate of the material to be dispensed; and a locking assembly for initiating the dispensing assembly to dispense the material;

wherein the microchip comprises:

a first glass wafer having a channel therein to allow passage of the material to be dispensed;

a filter wafer disposed on the first glass layer, said filter wafer comprising a plurality of pores extending therethrough, said pores being sized to prevent particles above a selected size from passing through the filter wafer;

a second glass wafer disposed on the filter wafer, said second glass wafer having a channel in passage alignment with the plurality of pores of the filter wafer; and an orifice wafer disposed on the second glass wafer, said orifice wafer having a bottom surface and a top surface and a channel therethrough, said channel having an entrance at the bottom surface of the orifice wafer and an exit at the top surface of the orifice wafer, said channel being in passage alignment with the channel of the second glass wafer;

whereby the material to be dispensed is provided a passageway through the channel in the first glass wafer, through the plurality of pores of the filter wafer, through the channel in the second glass water and out the exit at the top surface of the orifice wafer.

15. The precision release aerosol dispenser of claim 14, wherein the first glass wafer, the filter wafer, the second glass wafer, and the orifice wafer are joined together by fusing the layers together.

* * * * *

UNITED STATES PATENT AND TRADEMARK OFFICE

CERTIFICATE OF CORRECTION

PATENT NO. : 7,584,907 B2
APPLICATION NO. : 11/092108
DATED : September 8, 2009
INVENTOR(S) : Carl D. Contadini et al.

It is certified that error appears in the above-identified patent and that said Letters Patent is hereby corrected as shown below:

Column 9

Line 62, delete "water" and replace it with --wafer--

Column 12

Line 2, delete "water" and replace it with --wafer--

Signed and Sealed this

Third Day of November, 2009

David J. Kappos

David J. Kappos
*Director of the United States Patent and Trademark Office*